United States Patent [19]

Spann

[11] 4,214,326

[45] Jul. 29, 1980

[54] BODY POSITIONER AND PROTECTION APPARATUS

[76] Inventor: Donald C. Spann, 5 Ferncreek Crt., Greenville, S.C.

[21] Appl. No.: 44,180

[22] Filed: May 31, 1979

[51] Int. Cl.[3] ..... A47B 96/00; A47C 21/00

[52] U.S. Cl. ..... 5/431; 5/424

[58] Field of Search ..... 5/100, 400, 424–428, 5/431, 433 T, 443, 491; 46/16, 17; 248/345.1; 206/523; 273/153, 157

[56] References Cited

U.S. PATENT DOCUMENTS

| | | | |
|---|---|---|---|
| 2,628,373 | 2/1953 | Mahan | 5/425 |
| 3,148,387 | 9/1964 | Sarnic Jr. et al. | 5/513 |
| 3,280,499 | 10/1966 | Steiden | 46/17 |
| 3,401,411 | 9/1968 | Morrison | 5/481 |
| 3,430,272 | 3/1969 | Thorn | 5/513 |
| 3,938,205 | 2/1976 | Spann | 5/431 |
| 4,022,502 | 5/1977 | Smith et al. | 297/414 |
| 4,109,887 | 8/1978 | Wakeland, Jr. | 5/400 |

*Primary Examiner*—Casmir A. Nunberg
*Attorney, Agent, or Firm*—Bailey, Dority & Flint

[57] ABSTRACT

Apparatus for positioning and protecting a patient in bed is disclosed as including a protective device for cushioning a side frame of a hospital bed and the like which includes an elongated strip having a slot accommodating placement over the side frame and a thickened portion serving as a cushion. A body positioner formed from a block of polyurethane foam having resilient characteristics capable of deformation is disclosed having a length substantially greater than its width whereby the block may be placed on a base surface to provide a continuous support for the major portion of a patient's body while laying in bed. In a preferred embodiment, a core of the positioning block is cut out and may be removed and utilized as the protective side frame cushion while the body positioner block may be utilized to position the patient as desired.

6 Claims, 3 Drawing Figures

BODY POSITIONER AND PROTECTION APPARATUS

BACKGROUND OF THE INVENTION

It has been found that in many instances, it is necessary to position a bed patient lying laterally in bed in an angular position relative to the bed instead of a strictly supine position such as after surgery and for therapeutic conditions. In such an angular position, a patient is susceptible to falling against a protective side frame typically utilized on hospital type beds.

Heretofore, a body positioner block has been proposed for positioning a patient lying laterally upon an operating or examining table in an angular position in applicant's U.S. Pat. No. 3,938,205. However, when utilizing such a device in positioning the body of a patient lying laterally in bed, the patient is susceptible to falling against the side frame of the bed. Furthermore, it has been found desirable to protect patients undergoing therapeutic treatment in devices having sides such as whirlpool baths. Such is particularly the case when positioning an elderly patient or one severely immobilized.

Accordingly, it is an important object of the present invention to provide apparatus for positioning and protecting the body of a patient when lying in a hospital bed and the like.

Another important object of the invention is to provide apparatus for positioning and protecting the body of a patient while lying laterally upon a bed at an angular position relative to the bed wherein the body of a patient is protected should they fall against a protective side frame thereof.

Still another important object of the present invention is to provide a protective cushion device for cushioning a side frame of a device so as to cushion and protect the body of a patient should they fall thereagainst. Yet another important object of the present invention is to provide a body positioner and protective device wherein a body positioner includes a removable core which serves as a protective cushion over a side frame of a bed in which a patient is positioned.

SUMMARY OF THE INVENTION

It has been found that a body positioning and protecting apparatus for a patient lying upon a hospital bed and the like may be had in the form of a single elongated resilient foam block having a supporting surface for stably supporting a patient lying laterally wherein a removable core is formed and cut in the block which may be removed and serve as a protective cushion for the side frame of the bed.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 1:
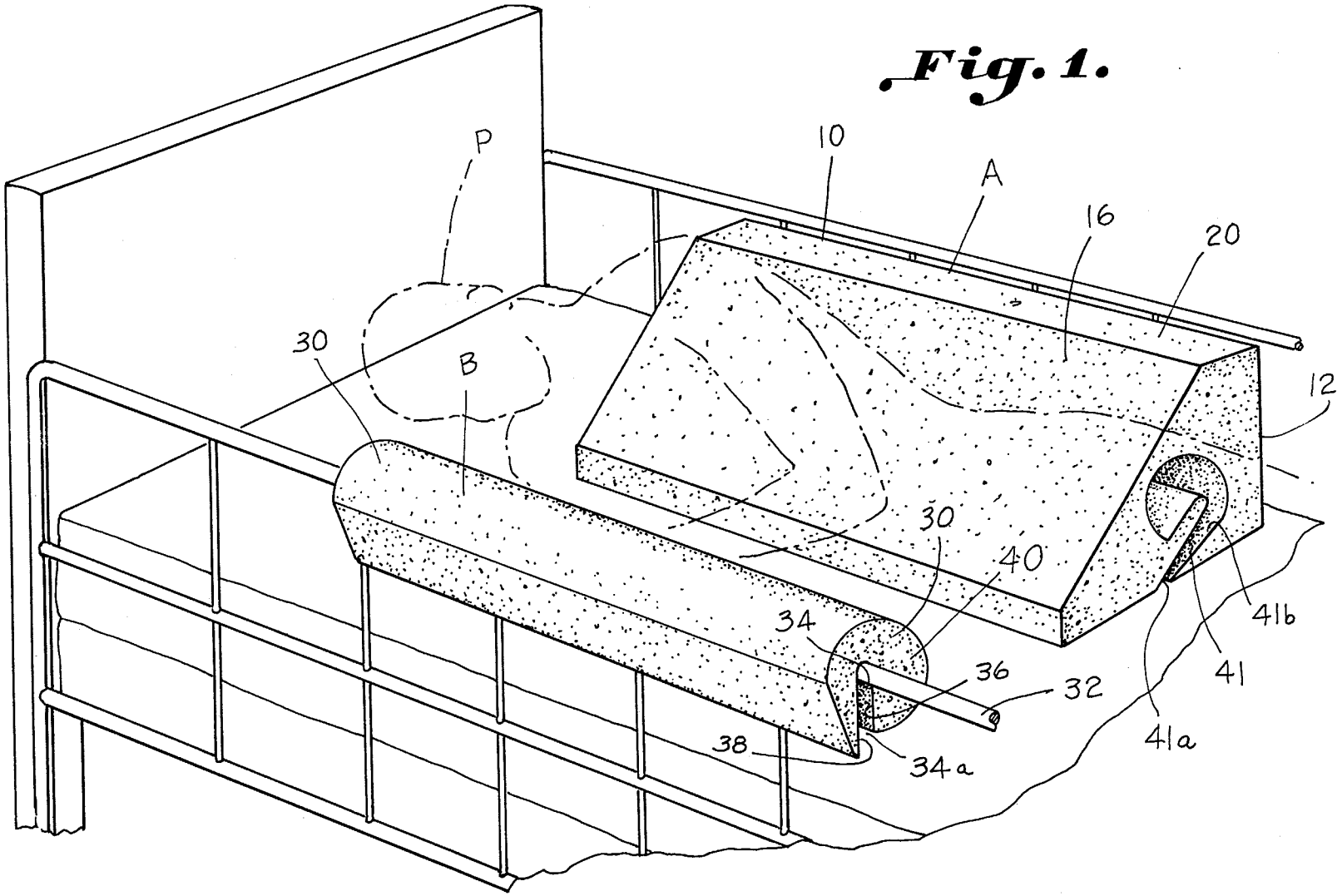
FIG. 1 is a perspective view illustrating apparatus according to the invention for positioning and protecting the body of a patient lying laterally in a hospital bed.
Figure 2:
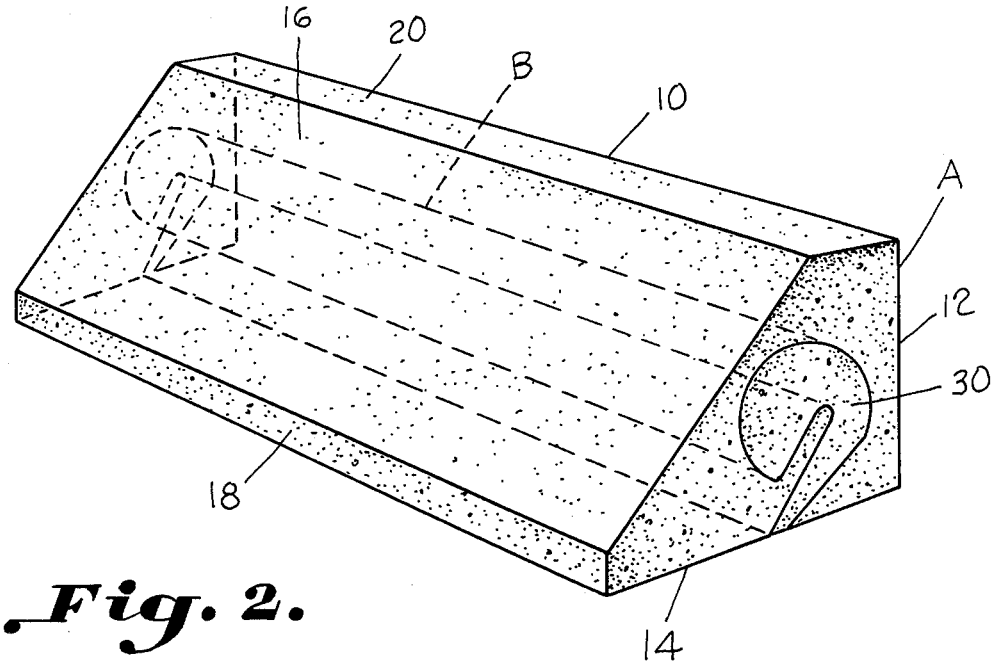
FIG. 2 is a perspective view of the body positioner and protective apparatus constructed according to the invention.

The drawing illustrates apparatus for protecting device having a side frame and apparatus for positioning the body of a patient lying laterally upon a bed including an elongated body positioner block A constructed from a resilient material having a length substantially greater than its width for stably supporting a substantial portion of the patients's lateral body length from approximately adjacent the shoulders to the waist. A removable body protection member B in the form of elongated core section is formed and cut out in the interior of the elongated body positioner block and includes a longitudinal internal channel means formed therein. An opening means is formed in the outside of the elongated core communicating with the channel means for accommodating placement of the elongated core over an edge of the side frame whereby the elongated core may be removed from the body positioner block and serve as a protective cushion over the side frame of the bed while the elongated body positioner may be utilized to position a patient in bed.

Referring now in more detail to the drawing, the body positioner device A is illustrated for variably adjusting the position of and supporting a patient lying laterally upon a bed surface and the like. The body positioner includes an elongated block 10 constructed of resilient deformable polyurethane material. The triangular block is advantageously shaped by cutting or sawing off triangular edge portions of different widths from the forty-five degree edges. The resulting elongated block is preferably unsymmetrical pentagonal cross-section having major planar surfaces 12, 14 and 16 and minor surfaces 18 and 20. For a more detailed description of the construction of a suitable body positioner block of this type, reference may be had to applicant's United States Pat. No. 3,938,205.

In use, the body protective device B can be based on any one of its three major surfaces for varying the position of the patient's body on a remaining major surface. With the patient's body being supported on one of the remaining major surfaces, the corresponding minor surface between the supporting major surface and the base surface provides a void space which facilitates increased circulation of air and patient comfort. Such provides a sufficient stable support for a patient in a side rotated position lying laterally on a bed surface.

As illustrated, the body protecting device B includes a core section 30 which is formed and cut out in the block 10 of the body positioner A such that it may be removed and utilized as illustrated to cushion a side frame 32 of a hospital bed and the like protecting the patient's body so positioned on the positioning block 10 such that should the patient fall from his side rotated position against the side frame 32, the patient will be protected. The core 30 preferably includes a channel means in the form of an inwardly extending block 34 wherein opening means is provided by the slot being open at its top 34a to accommodate placement of the core section over the side frame.

The slot 34 includes a pair of opposing side interior surfaces 36 and 38 wherein the side surface 38 extends past the side surface 36 so as to provide an abutment means which aids in retaining the core body on the edge of the side frame and preventing the core section from rotating laterally. The protective core includes a thickened portion at 40 between the slot 34 and an exterior portion of the core facing the patient which serves as a cushion to protect the patient thereagainst. It is to be understood, of course, that the protective core body B may be utilized over the edge of a side wall of any container in which a person or patient is placed such as a therapeutic whirlpool bath to protect the person against the side edges thereof. This is particularly useful when considering the placement and positioning of an elderly or highly immobilized person or patient.

The core section 30 is advantageously formed by cutting into block 10 and the entrance cut 41 is preferably formed at an angle to the major surface 14 so that when surface 14 is used as a base or a supporting surface, the angled interior surfaces 41a and 41b mate so as to adequately maintain the structural integrity of the block with the core removed. When not in use, the core cushion 30 may be advantageously stored with block 10.

Figure 3:
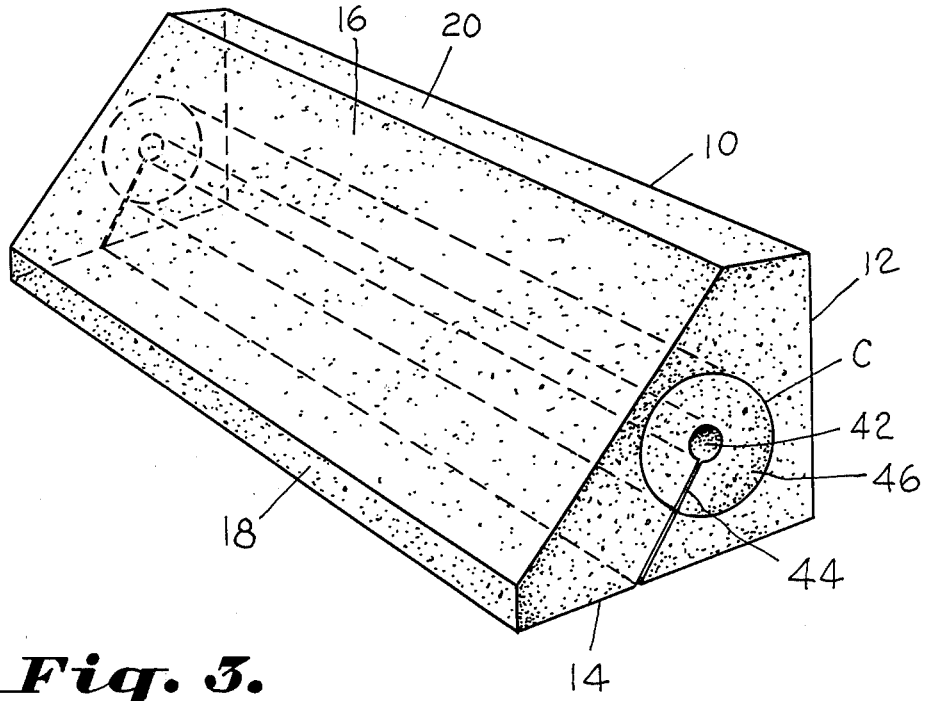
FIG. 3 is a perspective view of a alternate embodiment of a body positioner and protective apparatus according to the invention.

FIG. 3 represents another embodiment of the invention wherein the protective core cushion B includes a channel means in the form of a bore 42 extending the entire length thereof and wherein the opening means for accommodating placement of the core cushion over the edge of the side frame includes a narrow slit 44 extending from the outside of the core communicating with the bore 42. The opposing walls of the slit provide an increased gripping and retaining force of the sides of the frame over which the protective cushion device is placed. A thickened portion 46 between the bore 42 and exterior thereof provides a cushion. It will be noted that thickened portion 40 of the core 30 constitutes a major portion, over half, of the total thickness thereof.

Thus, it can be seen that an advantageous construction can be had for apparatus for positioning and protecting the body of a person wherein a positioning block device is made so as to incorporate a protective core section which may be removed and placed over the edge of a side frame of a hospital bed and the like to serve as a cushion. This provides a most advantageous and economical construction whereby the protection apparatus can be formed from a central core of the positioning apparatus and may be stored therein when not in use.

While a preferred embodiment of the invention has been described using specific terms, such description is for illustrative purposes only, and it is to be understood that changes and variations may be made without departing from the spirit or scope of the following claims.

I claim:

1. Apparatus for positioning and protecting the body of a patient lying laterally upon a hospital bed and the like of the type having an upright side frame, said apparatus comprising:

an elongated body positioner block constructed from a resilient material having a length substantially greater than its width for stably supporting a substantial portion of the patient's lateral body length;

a removable elongated core formed and cut out in the interior of said elongated block;

longitudinal internal channel means formed in said core; and opening means formed in the outside of said core communicating with said channel means accommodating placement of said elongated core over an edge of said side frame;

whereby said elongated core may be selectively removed from said body positioner block and utilized as a protective cushion guarding said patient's body from forceful contact with said side frame of said bed while said elongated body positioner may be utilized to position a patient in said bed.

2. The apparatus of claim 1 wherein said elongated body member includes a thickened side portion intermediate said internal channel means and an exterior side portion thereof serving as a cushion to protect said patient from said forceful contact with said side frame.

3. The structure set forth in claim 2 wherein said thickened portion intermediate said channel means and said exterior is a major portion of the total thickness of said body member.

4. The apparatus of claim 1 wherein said channel means includes an inwardly extending slot formed in said body member and said opening means includes a top of said slot being open.

5. The apparatus of claim 1 wherein said slot includes opposing interior side surfaces wherein one of said side surfaces extends past the other providing a stabilizing abutment means aiding in the retention of said elongated body member over said side frame.

6. The apparatus of claim 1 wherein said channel means includes a bore extending along the length of said body member and said opening means includes a narrow slit extending from the outside of said body member to said bore defined by radial side surfaces separable to frictionally clamp said side frame therebetween.

* * * * *